US008806797B1

(12) United States Patent
Petersen

(10) Patent No.: US 8,806,797 B1
(45) Date of Patent: Aug. 19, 2014

(54) ELECTRONIC DEVICE SHOTGUN MOUNT

(71) Applicant: Marc D. Petersen, Oak Creek, WI (US)

(72) Inventor: Marc D. Petersen, Oak Creek, WI (US)

( * ) Notice: Subject to any disclaimer, the term of this patent is extended or adjusted under 35 U.S.C. 154(b) by 0 days.

(21) Appl. No.: 14/063,421

(22) Filed: Oct. 25, 2013

(51) Int. Cl.
*F41C 27/00* (2006.01)

(52) U.S. Cl.
CPC ..... *F41C 27/00* (2013.01)
USPC ..... 42/90

(58) Field of Classification Search
CPC ..... F41C 27/00
USPC ..... 42/90, 124, 127, 146, 106; D22/110, D22/109; 362/110
See application file for complete search history.

(56) References Cited

U.S. PATENT DOCUMENTS

| | | | | | |
|---|---|---|---|---|---|
| 1,923,531 | A | | 8/1933 | De Florez | |
| 2,128,526 | A | * | 8/1938 | Eslick | 362/282 |
| 2,314,061 | A | * | 3/1943 | Whaley | 362/110 |
| 3,739,167 | A | | 6/1973 | Avery | |
| D298,739 | S | * | 11/1988 | Richards, Jr. | D8/395 |
| 4,894,941 | A | * | 1/1990 | Karow, Jr. | 42/146 |
| D394,096 | S | * | 5/1998 | Edgar | D22/110 |
| D415,239 | S | * | 10/1999 | Fell et al. | D22/110 |
| D672,004 | S | * | 12/2012 | Stracener | D22/108 |
| 8,656,624 | B2 | * | 2/2014 | Holmberg | 42/90 |
| 2007/0137087 | A1 | * | 6/2007 | Florea et al. | 42/90 |
| 2012/0240444 | A1 | * | 9/2012 | Russell | 42/90 |
| 2013/0251358 | A1 | | 9/2013 | Kuehl et al. | |
| 2014/0182186 | | * | 7/2014 | Stewart | 42/114 |

* cited by examiner

*Primary Examiner* — Reginald Tillman, Jr.
(74) *Attorney, Agent, or Firm* — Donald J. Ersler

(57) ABSTRACT

A electronic device shotgun mount preferably includes a mounting plate, an attachment device, a barrel snap member and a support gusset. The mounting plate extends from a top of the barrel snap member. The support gusset extends a length of the barrel snap member and substantially a length of a bottom of the mounting plate. The removable attachment device includes a mounting plate attachment pad and a phone attachment pad. The mounting plate attachment pad is secured to the mounting plate. The phone attachment pad is secured to a electronic device. The barrel snap member has a C-shaped cross section. The inner perimeter of the barrel snap member is sized to tightly receive a barrel of a shotgun. In use, the electronic device is attached to the mounting plate and the electronic device shotgun mount is snapped on to the barrel of the shotgun.

12 Claims, 5 Drawing Sheets

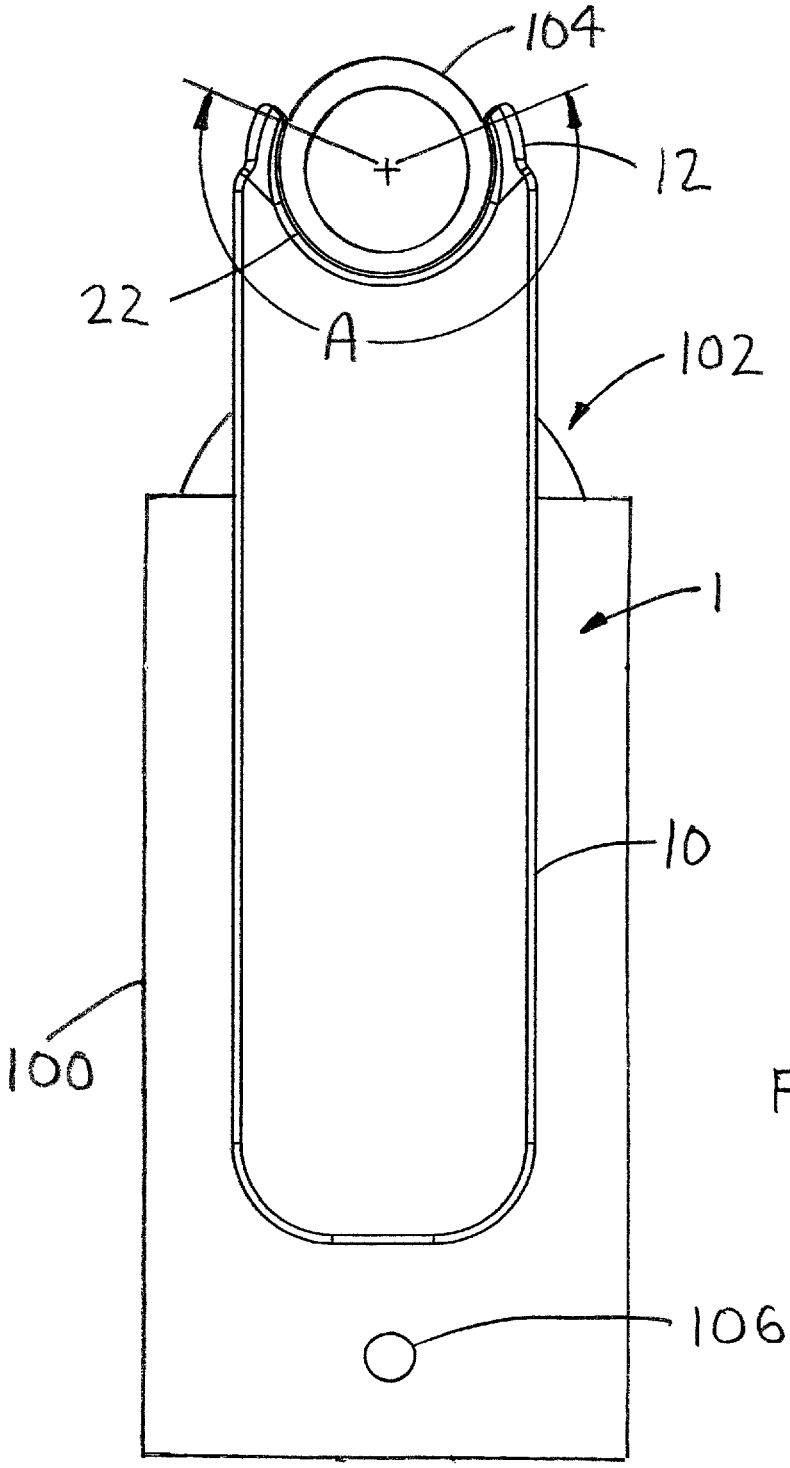
FIG, 5

ELECTRONIC DEVICE SHOTGUN MOUNT

BACKGROUND OF THE INVENTION

1. Field of the Invention

The present invention relates generally to hunting and more specifically to a electronic device shotgun mount, which may be used to record hunting of various game.

2. Discussion of the Prior Art

U.S. Pat. No. 1,923,531 to De Florez discloses an aim perfecting attachment for guns. U.S. Pat. No. 3,739,167 to Avery discloses a light for hunting weapon. Patent application no. 2013/0251358 to Kuehl et al. discloses a camera phone mount for a weapon scope.

Accordingly, there is a clearly felt need in the art for a electronic device shotgun mount, which may be used to record hunting of various game.

SUMMARY OF THE INVENTION

The present invention provides a electronic device shotgun mount, which may be used to record hunting of various game. The electronic device shotgun mount preferably includes a mounting plate, a barrel snap member and a support gusset. The mounting plate extends outward from a top of the barrel snap member. The support gusset preferably extends a length of the barrel snap member and at least substantially a length of a bottom of the mounting plate. A removable attachment device is used to removably secure a electronic device to the mounting plate. The electronic device may be a smart phone, a cell phone or any other device with a camera. The removable attachment device includes a mounting plate attachment pad and a phone attachment pad. The removable attachment device is preferably a dual lock product, which is manufactured by the 3M company, but other removable attachment devices may be used such as hook and loop fasteners. The mounting plate attachment pad is secured to the mounting plate. The phone attachment pad is secured to a electronic device. The barrel snap member has a C-shaped cross section. The C-shaped cross section has an inner perimeter of about 180 degrees. The inner perimeter of the barrel snap member is sized to tightly receive a barrel of a shotgun. In use, the electronic device is attached to the mounting plate and the electronic device shotgun mount is snapped on to the barrel of the shotgun. The electronic device shotgun mount is rotated to a desired position on the barrel.

Accordingly, it is an object of the present invention to provide a electronic device shotgun mount, which may be used to record hunting of various game.

These and additional objects, advantages, features and benefits of the present invention will become apparent from the following specification.

BRIEF DESCRIPTION OF THE DRAWINGS

FIG. 5 is a rear view of a electronic device shot gun mount retained on a shotgun barrel with a electronic device attached thereto in accordance with the present invention.

DETAILED DESCRIPTION OF THE PREFERRED EMBODIMENTS

Figure 1:
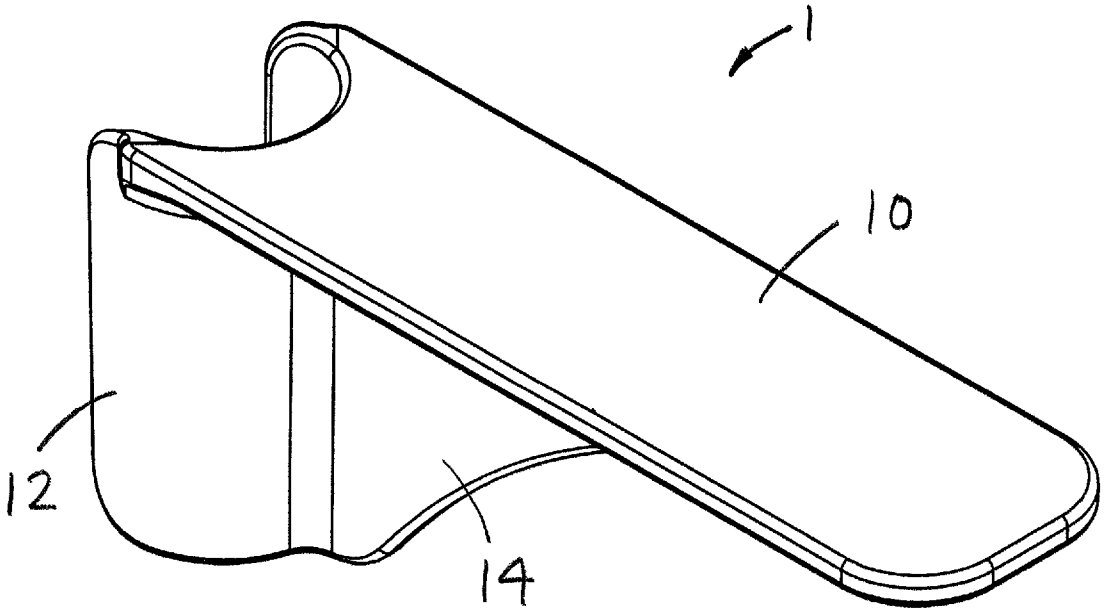
FIG. 1 is a perspective view of a electronic device shotgun mount in accordance with the present invention.
Figure 2:
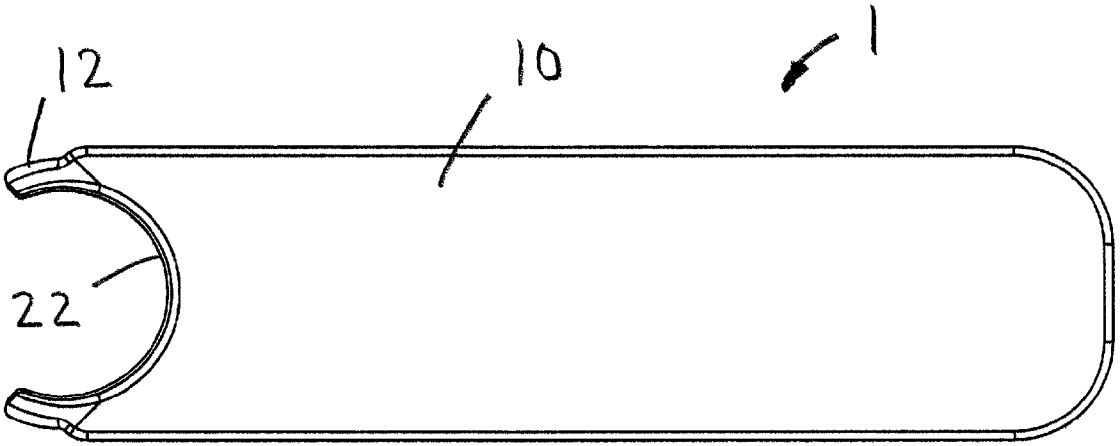
FIG. 2 is a top view of a electronic device shotgun mount in accordance with the present invention.
Figure 3:
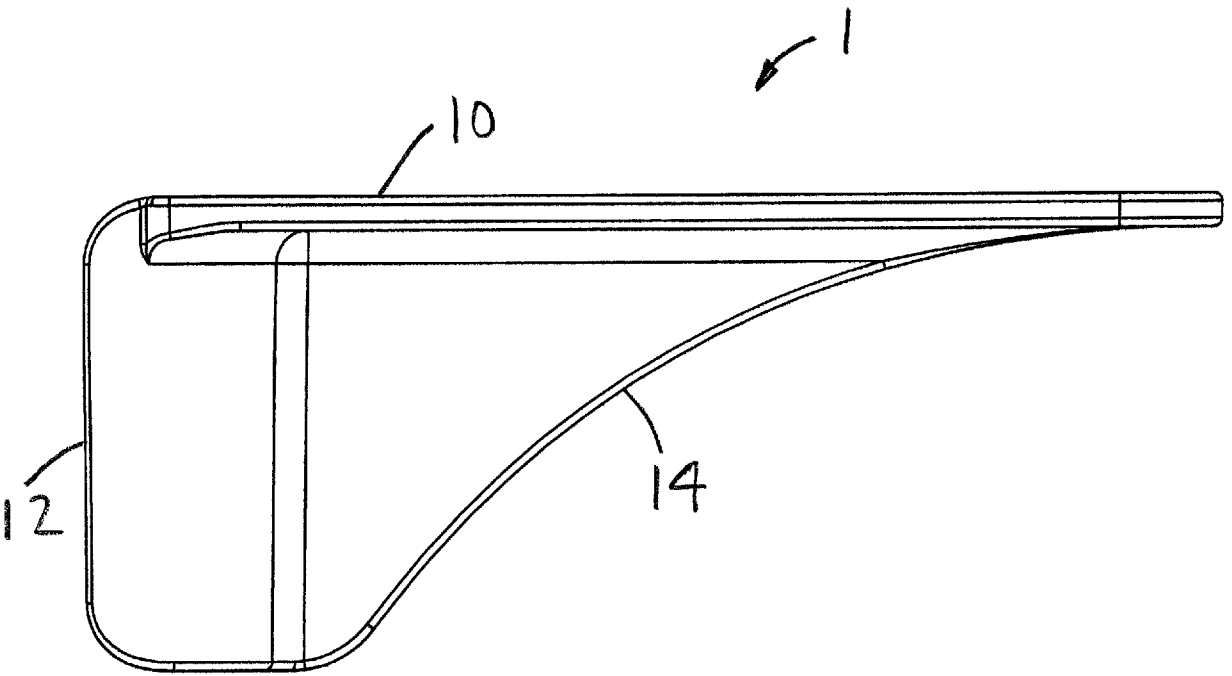
FIG. 3 is a side view of a electronic device shotgun mount in accordance with the present invention.
Figure 4:
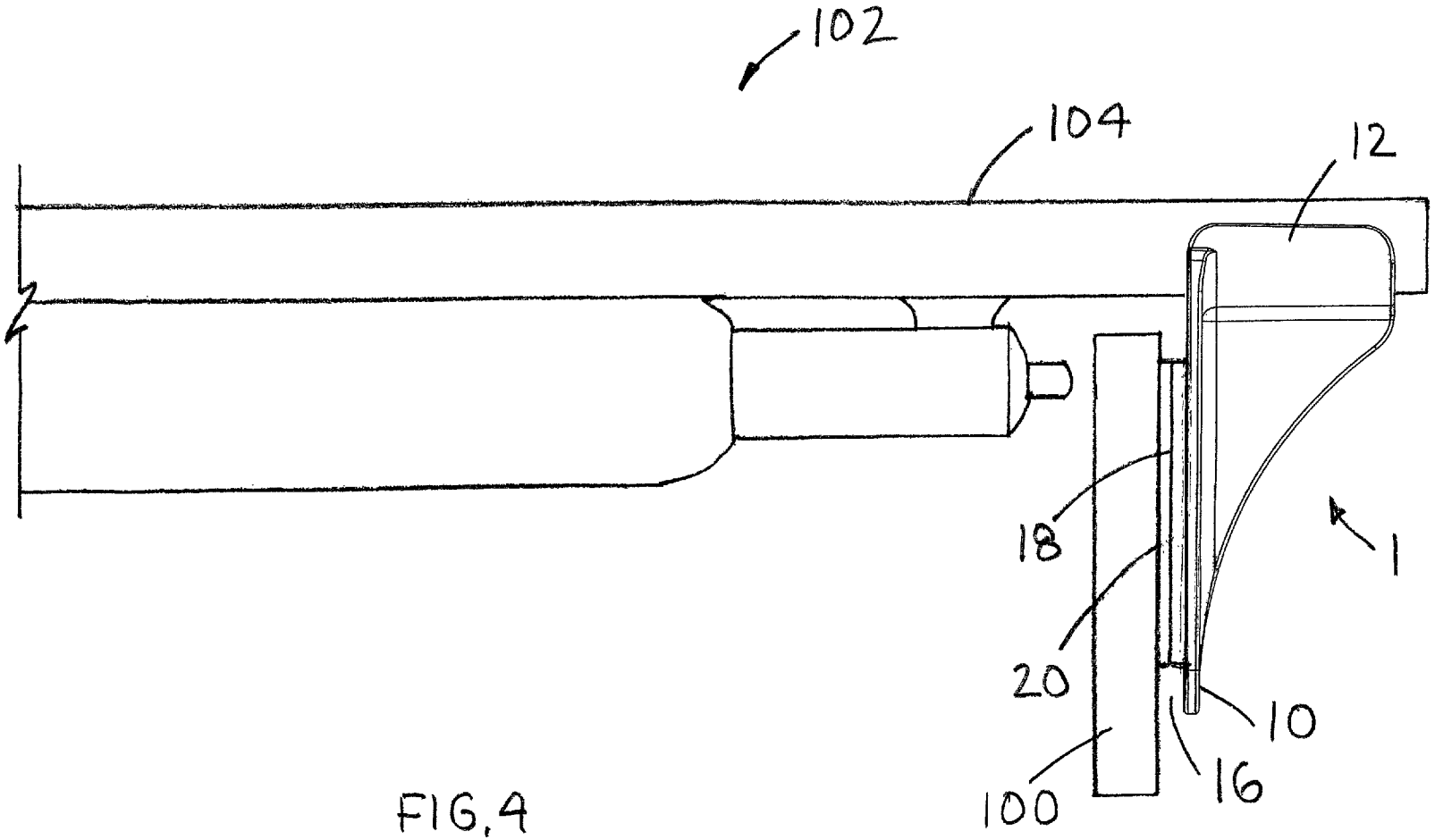
FIG. 4 is a side view of a electronic device attached to a electronic device shotgun mount and electronic device shotgun mount retained on a shotgun barrel in accordance with the present invention.

With reference now to the drawings, and particularly to FIG. 1, there is shown a perspective view of a electronic device shotgun mount 1. With reference to FIGS. 2-5, the electronic device shotgun mount 1 preferably includes a mounting plate 10, a barrel snap member 12 and a support gusset 14. The electronic device shotgun mount 1 is preferably molded from plastic, but other materials and processes may also be used. The mounting plate 10 extends outward from a top of the barrel snap member 12. The support gusset 14 preferably extends a length of the barrel snap member 12 and substantially a length of a bottom of the mounting plate 10. A portion of a perimeter of the support gusset 14 is shown as being inwardly curved, but could have any other suitable shape, such as straight.

A removable attachment device 16 is used to removably secure a electronic device 100 to the mounting plate 10. The removable attachment device 16 includes a mounting plate attachment pad 18 and a phone attachment pad 20. The mounting plate attachment pad 18 and the phone attachment pad 20 are preferably identical interlocking pads with a self-stick adhesive side and an attachment side. The removable attachment device 16 is preferably a dual lock product, which is manufactured by the 3M company, but other removable attachment devices may be used such as hook and loop fasteners. The barrel snap member 12 has a C-shaped cross section. The C-shaped cross section has an inner perimeter 22, which has an included angle A. The included angle A has a value of about 180 degrees. The mounting plate 10 extends outward from a closed portion of the C-shaped cross section. The inner perimeter 22 of the barrel snap member 12 is sized to tightly receive a barrel 104 of a shotgun 102.

In use, an adhesive side of the mounting plate attachment pad 18 is attached to a top of the mounting plate 10. An adhesive side of the phone attachment pad 20 is secured to a rear of the electronic device 100. An opposite attachment side of the mounting plate attachment pad 18 is pressed on to an opposite attachment side of the phone attachment pad 20, such that a camera lens 106 of the electronic device 100 is viewable. The barrel snap member 12 is snapped on to the barrel 102 of the shotgun 104. The electronic device shotgun mount 1 is rotated to a desired position on the barrel 102. The electronic device shotgun mount 1 may also be attached to other types of firearms.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A electronic device firearm mount comprising:

a barrel snap member includes a C-shaped cross section, an inner perimeter of said C-shaped cross section is sized to receive a barrel of a firearm;

a mounting plate extends from a closed portion of said C-shaped cross section; and a support gusset extends from said barrel snap member and from a bottom of said mounting plate, wherein a electronic device is removably secured to said mounting plate, said barrel snap member is snapped over the barrel of the firearm.

2. The electronic device firearm mount of claim 1 wherein:

an included angle of said C-shaped cross section is about 180 degrees.

3. The electronic device firearm mount of claim 1 wherein:

the electronic device is secured to said mounting plate with identical interlocking pads.

4. The electronic device firearm mount of claim 1 wherein:

the electronic device is secured to said mounting plate with hook and loop fastening pads.

5. A electronic device firearm mount comprising:

a barrel snap member includes a C-shaped cross section, an inner perimeter of said C-shaped cross section is sized to receive a barrel of a firearm;

a mounting plate extends from a closed portion of said C-shaped cross section; and a support gusset extends from said barrel snap member and a bottom of said mounting plate;

a removable attachment device includes a mounting plate attachment pad and a phone attachment pad, wherein said phone attachment pad is secured to the phone, said mounting plate attached pad is secured to said mounting plate, said phone attachment pad is removable secured to said mounting plate attachment pad, said barrel snap member is snapped over the barrel of the firearm.

6. The electronic device firearm mount of claim 5 wherein:

an included angle of said C-shaped cross section is about 180 degrees.

7. The electronic device firearm mount of claim 5 wherein:

the electronic device is secured to said mounting plate with identical interlocking pads.

8. The electronic device firearm mount of claim 5 wherein:

the electronic device is secured to said mounting plate with hook and loop fastening pads.

9. A electronic device firearm mount comprising:

a barrel snap member includes a C-shaped cross section, an inner perimeter of said C-shaped cross section is sized to receive a barrel of a firearm;

a mounting plate extends from a closed portion of said C-shaped cross section; and a support gusset extends from said barrel snap member and a bottom of said mounting plate;

a removable attachment device includes a mounting plate attachment pad and a phone attachment pad, said attachment pads have an adhesive side and an opposite removable attachment side, wherein said adhesive side of said phone attachment pad is secured to the phone, said adhesive side of said mounting plate attached pad is secured to said mounting plate, said phone attachment pad is removable secured to said mounting plate attachment pad, said barrel snap member is snapped over the barrel of the firearm.

10. The electronic device firearm mount of claim 9 wherein:

an included angle of said C-shaped cross section is about 180 degrees.

11. The electronic device firearm mount of claim 9 wherein:

the electronic device is secured to said mounting plate with identical interlocking pads.

12. The electronic device firearm mount of claim 9 wherein:

the electronic device is secured to said mounting plate with hook and loop fastening pads.

* * * * *